US006182674B1

(12) United States Patent
Jozwiak et al.

(10) Patent No.: US 6,182,674 B1
(45) Date of Patent: Feb. 6, 2001

(54) PUMP AND SOIL COLLECTION SYSTEM FOR A DISHWASHER

(75) Inventors: Todd M. Jozwiak, Benton Harbor; Edward L. Thies, Niles, both of MI (US); Claude W. Miller, Troy, OH (US); Roger J. Bertsch, Stevensville; Wilbur W. Jarvis, St. Joseph, both of MI (US)

(73) Assignee: Whirlpool Corporation, Benton Harbor, MI (US)

( * ) Notice: Under 35 U.S.C. 154(b), the term of this patent shall be extended for 0 days.

(21) Appl. No.: 09/326,280

(22) Filed: Jun. 4, 1999

Related U.S. Application Data

(63) Continuation-in-part of application No. 08/927,706, filed on Sep. 10, 1997, now Pat. No. 5,909,743

(60) Provisional application No. 60/031,182, filed on Nov. 19, 1996.

(51) Int. Cl.[7] ..... A47L 15/46

(52) U.S. Cl. ..... 134/56; 134/104.1; 134/104.4; 134/111

(58) Field of Search ..... 134/104.1, 104.4, 134/111, 10, 18, 25.2, 56 D, 57 D, 115 G

(56) References Cited

U.S. PATENT DOCUMENTS

| | | | |
|---|---|---|---|
| 3,457,929 | 7/1969 | Madden | 134/95 |
| 3,807,418 | 4/1974 | Jenkins | 134/57 |
| 4,228,962 | 10/1980 | Dingler et al. | 241/36 |
| 4,392,891 | 7/1983 | Meyers | 134/10 |
| 4,477,343 | 10/1984 | Tucker | 210/108 |
| 4,559,959 | 12/1985 | Meyers | 134/56 |
| 4,673,441 | 6/1987 | Mayers | 134/18 |
| 4,972,861 | 11/1990 | Milocco et al. | 134/104.1 |
| 5,097,855 | 3/1992 | Martinsson et al. | 134/57 |
| 5,165,433 | 11/1992 | Thies et al. | 134/104.4 |
| 5,165,435 | 11/1992 | Thies et al. | 134/181 |
| 5,320,120 | 6/1994 | Hoffman et al. | 134/104.1 |
| 5,401,397 | 3/1995 | Moorehead | 210/108 |
| 5,803,100 | 9/1998 | Thies | 134/104.4 |

*Primary Examiner*—Philip R. Coe
(74) *Attorney, Agent, or Firm*—Joel M. Van Winkle; Robert O. Rice; Stephen D. Krefman

(57) ABSTRACT

A dishwasher is provided having a wash pump and soil collection system. The wash pump may be a volute type pump having a horizontal axis and includes a casing surrounding a wash impeller. The casing has a main outlet and a secondary outlet. The wash impeller draws wash liquid from the dishwasher sump region and pumps the wash liquid through the main outlet and the secondary outlet. The wash liquid pumped through the main outlet is provided to a wash arm device such that wash liquid is recirculated throughout the dishwasher interior wash chamber. The wash liquid pumped through the secondary outlet is directed to flow into a soil collector. The soil collector includes a soil separation channel which receives the flow from the secondary outlet and includes at least one filter screen panel for returning filtered wash liquid back into the sump such that soils are retained in the soil separation channel and accumulate within a soil accumulator region. A pressure sensor may be provided for sensing the pressure within the soil accumulator. A drain pump is provided having an inlet fluidly connected to the soil separation channel. When the pressure within the soil collector exceeds a predetermined limit level, the drain pump is energized such that soils are cleared or purged from the soil collector. Alternatively, a second outlet may be provided in the soil collector through which wash liquid flows back into the wash chamber when the filter screen is clogged with soils.

25 Claims, 14 Drawing Sheets

PUMP AND SOIL COLLECTION SYSTEM FOR A DISHWASHER

This is a continuation-in-part of application Ser. No. 08/927,706, entitled "AUTOMATIC PURGE FILTRATION SYSTEM FOR A DISHWASHER", filed on Sep. 10, 1997, and now U.S. Pat. No. 5,909,743, which claimed the benefit of U.S. Provisional Application Ser. No. 60/031,182 filed on Nov. 19, 1996.

BACKGROUND OF THE INVENTION

The present invention relates to a dishwasher filtration and soil collection system, and more particularly to a system for automatically purging a filter and soil collection system in a dishwasher to remove accumulated soils.

Typical domestic dishwashers in use today draw wash liquid from a sump at the bottom of a wash tub and spray the wash liquid within the wash tub to remove soils from dishes located on racks in the tub. In an attempt to improve performance and efficiency, some dishwashers employ a system for separating soil out of the recirculating wash liquid and for retaining the soils in a collection chamber. Frequently, a filter screen is used to retain soil in a soil collection chamber. U.S. Pat. No. 5,165,433, for example, discloses a dishwasher system including a centrifugal soil separator which sends soil laden wash liquid into a soil container whereupon the soil laden wash liquid passes through a fine filter disposed in the wall of the soil container.

Inherent in the system described in the '433 patent, and in any fine mesh filter screen system in a dishwasher, is the problem of screen clogging by food soils removed from the dishes. Typically, backwash jets are directed against the filter in an attempt to clear the filter and prevent clogging. Heavy soil loads, however, can result in screen clogging in spite of backwash jets.

Screen clogging can adversely affect the dishwasher's cleaning ability, causing poor washability and indirectly causing increased water and energy consumption. Moreover, the build-up of pressure behind the screen may increase—to a maximum determined by the ability of the pump supplying soil laden wash liquid against the screen—and result in soil embedding into the screen such that it is difficult to subsequently remove the soils from the screen.

Some attempts have been made to develop a dishwasher wash system which is capable of dealing with heavy soil loads and avoid filter clogging. U.S. Pat. No. 4,559,959 discloses a dishwasher wherein soil load is measured by monitoring pressure in a soil collection chamber in which soils are retained after the wash liquid passes through a filter mesh. If the pressure exceeds a predetermined limit, indicating that the filter mesh is clogged, the wash liquid is completely purged by draining all of the wash liquid out of the tub and refilling the tub with fresh water. The '959 patent provides for a maximum of three complete purges at the beginning of the dishwasher cycle. Additionally, the number of purges required is monitored and that information is used to control the subsequent wash cycle—selecting the appropriate cycle for the soil load of the dishes.

Concerns over dishwasher water and energy consumption make complete purges of wash liquid from a tub undesirable. Accordingly, some dishwasher systems utilize purges which only partially drain the dishwasher tub. For example, U.S. Pat. No. 4,346,723 discloses a dishwashing system wherein soils are collected in a bypass soil collector. The soil collector may be purged by draining small amounts of wash liquid in "spurts" during an early wash period by selectively opening and closing a drain valve.

U.S. Pat. No. 5,223,042 discloses a method of washing dishes wherein during the wash cycle a portion of the washing solution is drained from the bottom of the tub to remove soils. The wash solution is subsequently replenished with fresh water having a volume equal to the volume of the discharged wash solution.

U.S. Pat. No. 5,429,679 includes a soil collection system wherein wash liquid is sent into a filtration chamber and then returned to the tub sump through a filter. After the first wash cycle, a portion of wash liquid, approximately 1 gallon out of the total 2.3 gallons of wash liquid, is sent to drain and then replaced by adding fresh water to the tub.

The above described systems all include several drawbacks. One of the most significant is that, for all of these references, a relatively large quantity of water is drained during each purge. Moreover, several of the above references teach interrupting the wash operation during each drain purge such that no spray is directed against the dishes while wash liquid is being purged. Another problem with the above described systems is one of soil redeposition wherein soils, collected in the soil collection chamber prior to each purge, are redeposited onto the dishes during the purge cycle.

In addition to the inadequacies of the prior art in dealing with clogging filter screens, there exists a need for a dishwasher having improved energy efficiency. As discussed above, the need for a dishwasher which high efficient in its use of water and power is well understood. One of the functions of a dishwasher is to provide mechanical energy for soil removal by pumping water through a spray system for application against soiled dishes. An efficient dishwasher, therefore, requires a highly efficient pump.

It is well known that volute type pumps, wherein a centrifugal pump is housed in a spiral casing so that rotational speed will be converted to pressure without shock, are highly efficient pump designs. This type of pump is used extensively in dishwashers because of its efficiency, see for example U.S. Pat. No. 4,243,431 and U.S. Pat. No. 5,268,334. Another type of pump extensively used in dishwashers are vertical axis pump systems where the flow of wash liquid is perpendicular to the plane in which the pump impeller rotates, such as the pump system disclosed in the '433 patent. These types of vertical axis pumps where flow is normal to the rotation of the impeller are less efficient than volute type pumps in a dishwasher. However, the soil separation systems, discussed above, that have been developed for use with vertical axis pump systems in dishwasher make these vertical axis pump systems operate in a highly efficient and effective manner. For example, the soil separation system disclosed and claimed in U.S. Pat. No. 5,803,100, to Thies, provides for a very efficient separation of soils from the recirculating wash liquid in a dishwasher such that the overall dishwasher efficiency is increased.

It can be understood therefore, by one skilled in the art, that there is a need for a dishwasher which is capable of recirculating wash liquid through the dishwasher, removing soils from dishware and sending the removed soils to drain in an effective and highly efficient manner.

SUMMARY OF THE INVENTION

It would therefore be desirable, to provide a dishwasher capable of effectively cleaning dishes or dishware which are soiled. In accordance with the present invention, a dishwasher is provided having a wash pump and soil collection system. The wash pump may be a volute type pump having a horizontal axis and includes a casing surrounding a wash impeller. The casing has a main outlet and a secondary outlet. The wash impeller draws wash liquid from the dishwasher sump region and pumps the wash liquid through the main outlet and the secondary outlet. The wash liquid pumped through the main outlet is provided to a wash arm device such that wash liquid is recirculated throughout the dishwasher interior wash chamber. The wash liquid pumped through the secondary outlet is directed to flow into a soil collector. The soil collector includes a soil separation channel which receives the flow from the secondary outlet and includes at least one filter screen panel for returning filtered wash liquid back into the sump such that soils are retained in the soil separation channel and accumulate within a soil accumulator region.

In accordance with the present invention, the pressure within the soil accumulator is sensed by a pressure sensor. A drain pump is provided having an inlet fluidly connected to the soil separation channel. When the pressure within the soil collector exceeds a predetermined limit level, the drain pump is energized such that soils are cleared or purged from the soil collector. In this manner, the soil collector and the filter screen panels may be cleared of soils. When the pressure within the soil collector is reduced to below the predetermined limit level, the drain pump is de-energized. Alternatively, the drain pump may be de-energized after a predetermined amount of time—such as five seconds. The purging operation may be repeated a plurality of times in response to clear soils from the soil accumulator.

In accordance with another aspect of the invention, the dishwasher further includes a drain conduit fluidly connecting the sump to the drain pump. A control valve is provided for preventing fluid flow from the dishwasher sump to the drain pump during the purging operation while the wash pump is operating. The control valve is operated in response to fluid pressure created by the wash pump.

In accordance with still another aspect of the present invention, a dishwasher is provided having a tub forming an interior wash chamber including a bottom wall wherein the tub receives wash liquid from a water inlet. A wash pump is connected to the bottom wall for recirculating wash liquid throughout the wash chamber. The wash pump has an impeller and a pump housing surrounding the impeller wherein the pump housing has a main pump outlet and a secondary pump outlet. A wash arm is positioned above the wash pump for receiving wash liquid from the wash pump through the main pump outlet and spraying wash liquid within the tub. A soil collector is disposed below the wash arm and receives wash liquid from the wash pump through the secondary pump outlet. The soil collector includes an inlet for receiving wash liquid from the secondary pump outlet and a channel for receiving wash liquid from the inlet. The channel has a drain outlet and at least one wall having a filter screen wherein wash liquid received into the soil collector flows into the channel and passes through the filter screen such that soils are collected in the soil collector. A second outlet is provided in the soil collector through which wash liquid flows back into the wash chamber when the filter screen is clogged with soils. More specifically, the soil collector includes an inlet conduit through which wash liquid passes to enter into the channel and the second outlet is located along the inlet conduit. The inlet conduit includes a fluid restriction upstream of the second outlet such that the velocity of wash liquid supplied into the channel is increased.

DETAILED DESCRIPTION OF THE PREFERRED EMBODIMENTS

Figure 1:
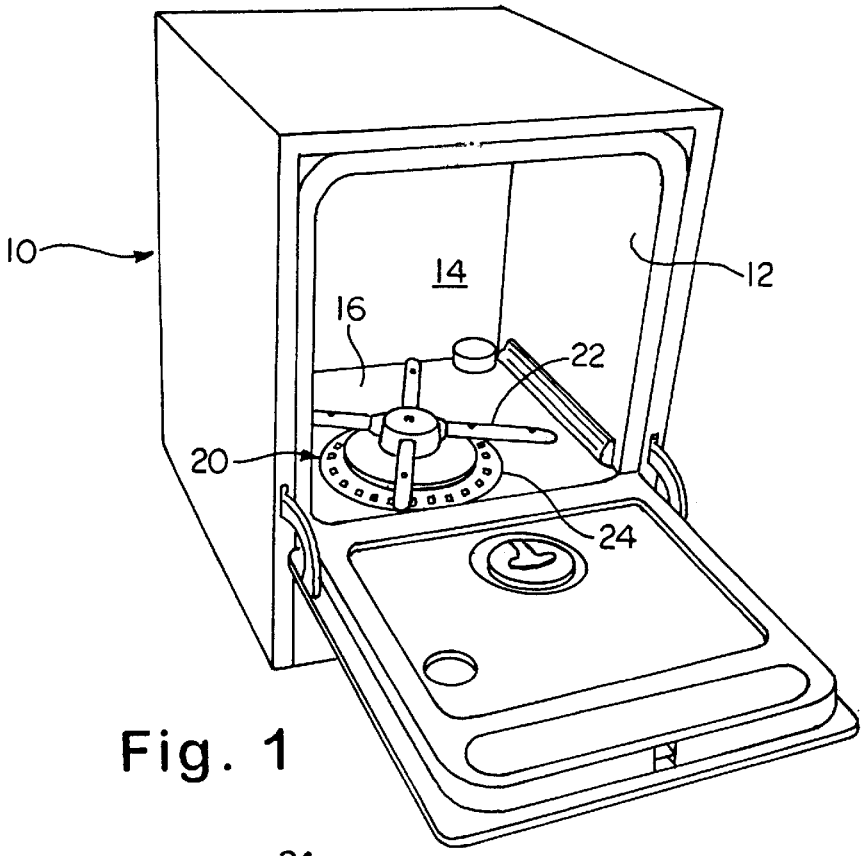
FIG. 1 is a perspective view of a dishwasher including a soil separation and collection system in accordance with the present invention.

In accordance with the invention as shown in the drawings, and particularly as shown in FIG. 1, an automatic dishwasher generally designated 10 includes an interior tub 12 forming an interior wash chamber or dishwashing space 14. The tub 12 includes a sloped bottom wall 16 which defines a lower tub region or sump 18 (FIG. 4) of the tub. A soil separator and pump assembly 20 is centrally located in the bottom wall 16 and has a lower wash arm assembly 22 extending from an upper portion thereof. A coarse particle grate 24 permits wash liquid to flow from the bottom wall 16 to soil separator 20 while preventing large foreign objects from entering the pump system.

The basic constructional features of the soil separator are explained in U.S. Pat. No. 5,803,100, to Thies, entitled "SOIL SEPARATION CHANNEL FOR A DISHWASHER PUMP SYSTEM", herein incorporated by reference. In that application, the operation of a centrifugal soil separator and the construction of a soil separator and collector are fully explained.

Figure 3:
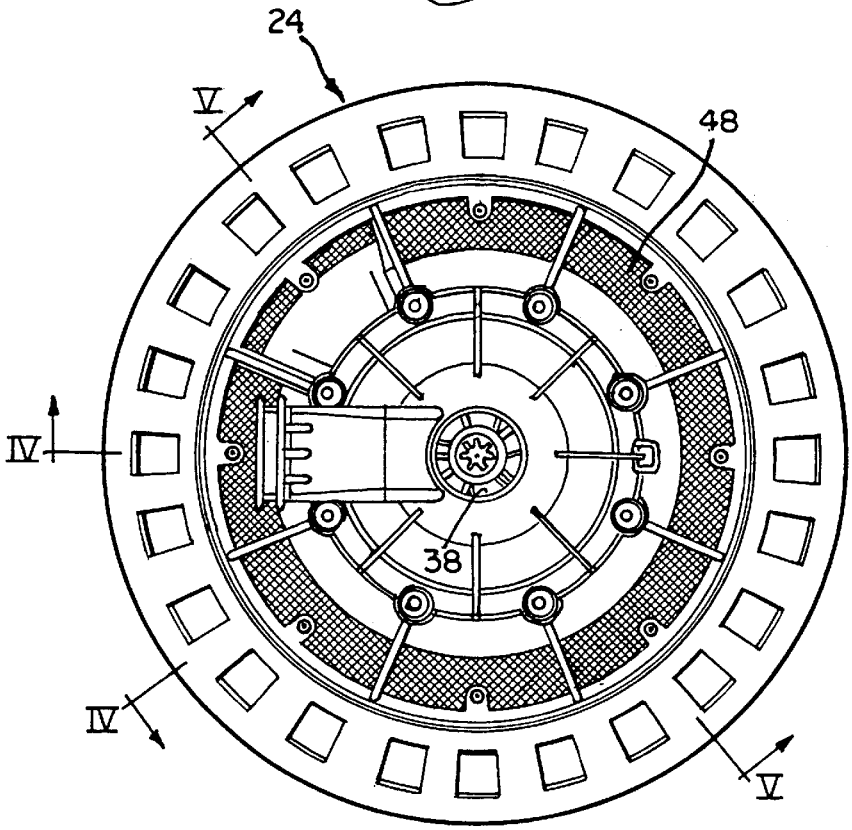
FIG. 3 is a top view of the pump system of the dishwasher shown in FIG. 1.
Figure 2:
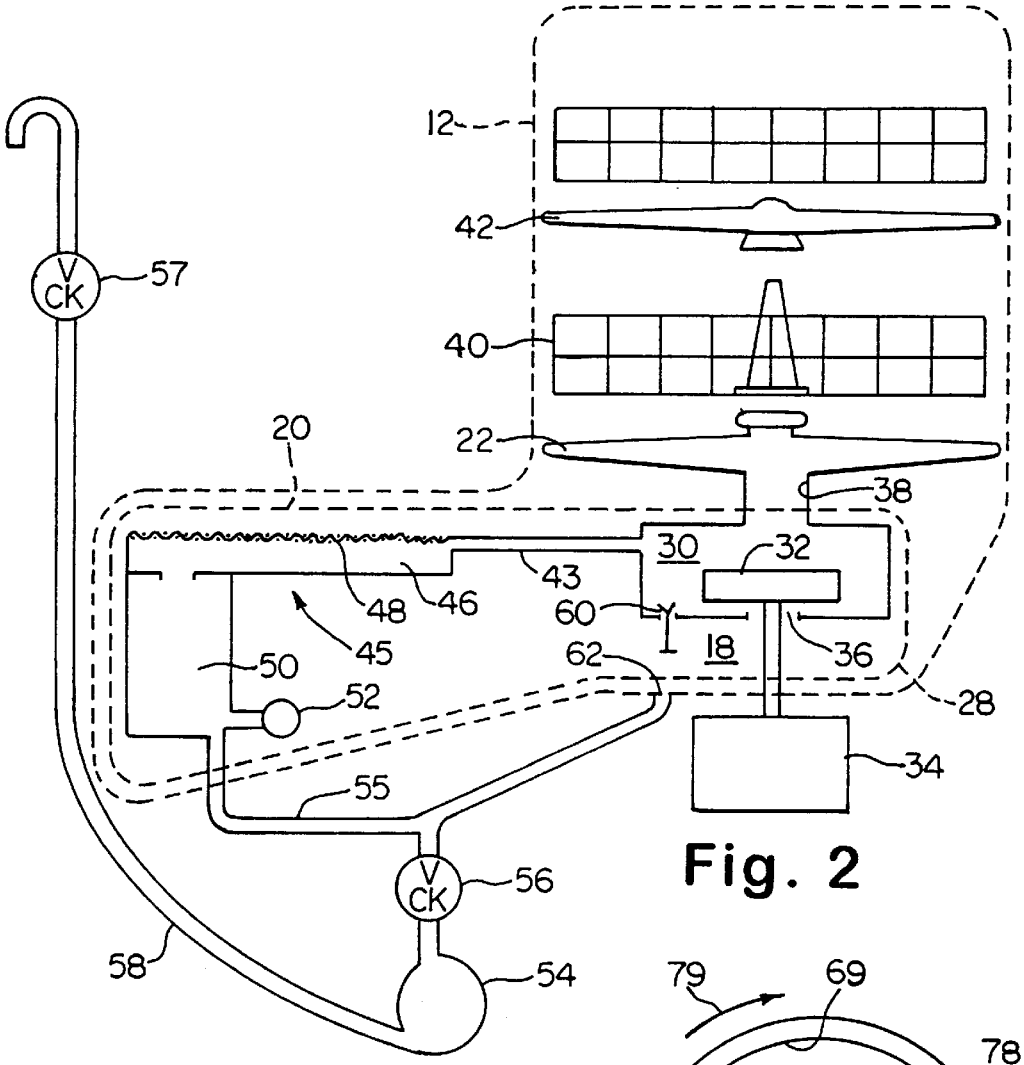
FIG. 2 is a schematic illustration of the soil separation and collection system of the present invention and embodied in the dishwasher shown in FIG. 1.
Figure 4:
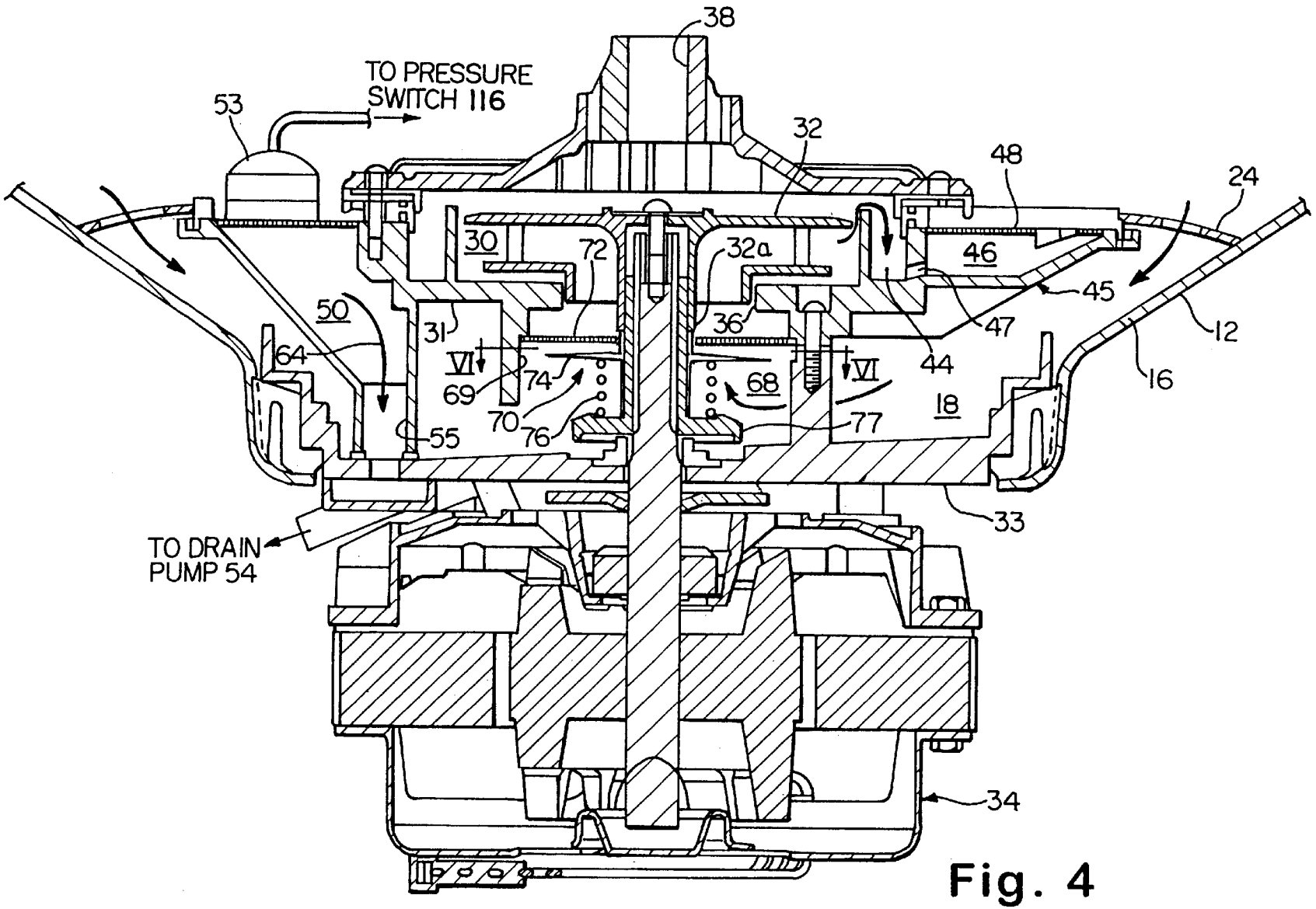
FIG. 4 is a diametric sectional view taken along line IV—IV of FIG. 3, illustrating fluid flow during soil accumulator purging.

Turning to FIGS. 2, 3 and 4, it can be seen that the soil separator/pump assembly 20 includes a wash pump 28 having a wash impeller 32 disposed within a pump chamber 30 defined by a pump housing 31. The pump housing 31 is supported by a pump base 33. During a wash cycle, the wash impeller 32, driven by motor 34, draws wash liquid from the sump 18 through a pump inlet 36, provided between the pump housing 31 and pump base 33, and pumps wash liquid up through a main pump outlet 38 into the lower spray arm 22. A first portion of wash liquid is sprayed from the lower spray arm 22 against dishes supported on a lower dishrack 40 and a second portion of wash liquid is directed toward an upper spray arm 42. Wash liquid is repeatedly recirculated over the dishes for removing soils therefrom.

Once soils are removed from the dishes, they are washed down into the sump 18, drawn into the pump inlet 36 whereupon the soils encounter a chopping region 68 defined by annular wall 69 surrounding a chopper assembly 70 for chopping and reducing the size of soil particles which enter the pump chamber 30. Many of the basic constructional features of the chopper assembly are explained in U.S. Pat. No. 4,319,599, entitled "Vertical Soil Separator for Dishwasher", herein incorporated by reference. The chopper assembly 70 includes a sizing screen 72 and a chopper 74 which is urged against a downwardly facing shoulder 32*a* of the wash impeller 32 by a coil spring 76. The upper distal end of the coil spring 76 extends radially outwardly into a groove provided in the chopper 74 and a lower distal end of the coil spring 76 extends into and is driven in rotation by a blind hole provided in drive hub 77.

Figure 6:
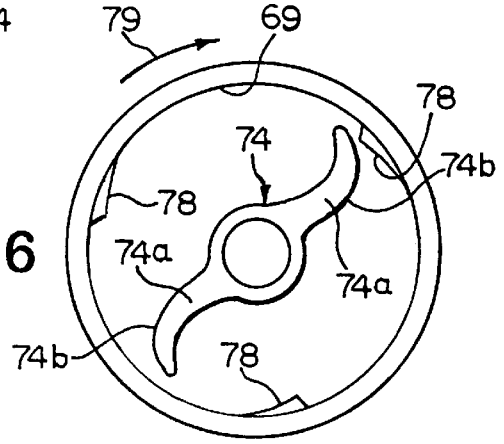
FIG. 6 is a transverse sectional view taken substantially along line VI—VI of FIG. 4.

As shown in FIG. 6, the chopper 74 includes a pair of outwardly extending, curved chopping blades 74*a* which are provided with sharp cutting edges 74*b* for comminuting soil particles that are trapped on the sizing screen 72 so that they may be reduced in size and subsequently pass through the sizing screen openings. The chopper 74 is driven in the rotational direction illustrated by arrow 79 such that soils which contact the cutting edges 74*b* and wrap about the chopping blades 74*a* are driven by the force of the water acting against the rotating chopper 74 to slide off the blade ends. Food soils swirling within the chopping region beyond the outer edges of the chopping blades 74*a* are driven back into the path of the blades 74*a* by deflector ribs 78 inwardly extending from the annular wall 69.

Referring now back to FIGS. 2 and 4, it can be understood that after being chopped and sized by the chopper assembly 70, the soils are drawn, along with the wash liquid, into the pump chamber 30. Within the pump chamber 30, under the action of the rotating wash impeller 32, the soils are centrifugally separated and a sample of wash liquid having a high concentration of entrained soils is directed to flow from the pump chamber 30 through a sample outlet 43 into a soil collector 45 comprising an annular soil separation channel 46 and a soil accumulator 50. The sample outlet 43 is illustrated as an annular guide chamber 44 having a bottom opening 47 through which soils flow into the soil separation channel 46. Accordingly, the soil laden wash liquid is directed to flow into the soil separation channel 46 which has top wall formed from a filter screen 48. As the soil laden wash liquid proceeds within the separation channel 46 in an annular path, water passes upwardly through the filter screen 48 and back into the sump 18 leaving the soils within the separation channel 46. Within the soil separation channel 46, the velocity of the remaining wash liquid slows and the soils settle into the soil accumulator 50.

During the wash cycle, the filter screen 48 is repeatedly backflushed. As the lower wash arm 22 rotates, pressurized wash liquid is emitted from downwardly directed backflush nozzles. Means may be provided for forming a fan-shaped spray from the flow of wash liquid through the backflush nozzles. As the lower wash arm rotates, this fan shaped spray sweeps across the filter screen 48 providing a backwashing action to keep the screen clear of soil particles which may impede the flow of cleansed wash liquid into the sump 18.

As described above, in spite of backflushing, in conditions of a heavy soil load, the filter screen 48 may become clogged with food soils. When this occurs, wash performance is impaired and pressure within the soil accumulator 50 increases. This pressure increase is sensed by a pressure sensor 52 associated with a pressure tap tube connected to a pressure dome 53 provided above the soil accumulator 50 such that the pressure sensor 52 measures pressure within the soil accumulator 50. The pressure sensor 52 can be either an analog device or a digital device. When the pressure in the soil accumulator exceeds a predetermined limit pressure, indicative of a clogged screen mesh 48, a drain pump 54 is energized to clear the screen mesh. The drain pump 54 draws wash liquid, highly concentrated with soils, from the soil accumulator 50 through drain conduit 55 and pumps it past a check valve 56 through drain hose 58 to drain. When the pressure in the accumulator is lowered below the predetermined limit pressure the drain pump is deenergized. The duration of time during which the drain pump 54 is energized to clear the accumulator 50 and the screen mesh 48 is referred to as purging or a purge period.

In this manner, the soil separation and collection system of the present invention is purged of soils. It can be understood, moreover, that since the drain pump 54 is separate from the wash pump 28, the purging of soils from the soil accumulator 50 and soil separation channel 46 can be accomplished while the wash pump impeller 32 continues to recirculate wash liquid through the dishwashing space 14.

It should be noted that for this type of plumbing configuration it is necessary to maintain a minimum drain head pressure that is greater than the trip pressure of the pressure switch. Otherwise, it is possible that the pressure build-up in the accumulator, associated with the clogging of the filter, will be great enough to force the accumulator contents past the drain pump if the head pressure is less than the trip pressure, resulting in all the water being eventually depleted from the dishwasher. Also, the water could be siphoned from the dishwasher after the purge periods. One solution would be to establish a loop in the drain tube 58 sufficient to provide the necessary pressure head and add a check valve 57 to the top of the drain tube 58 and have the check valve 57 open to the inside of the dishwasher to permit equalization of the air in the drain tube with the air in the tub.

As an alternative to the above described drain pump system, the present invention may utilize a drain pump driven by the wash pump motor in a manner similar to the drain pump described in U.S. Pat. No. 4,319,599, incorporated by reference above. In such a system, the pressure sensor 52 may be operated to control a drain valve associated with a drain line downstream of the drain pump such that when the filter screen 48 becomes clogged, the drain valve is opened to allow the drain pump to clear the accumulator. This type of system may have some undesirable leakage from the pump chamber into the drain pump area but would still provide beneficial results.

Figure 5A:
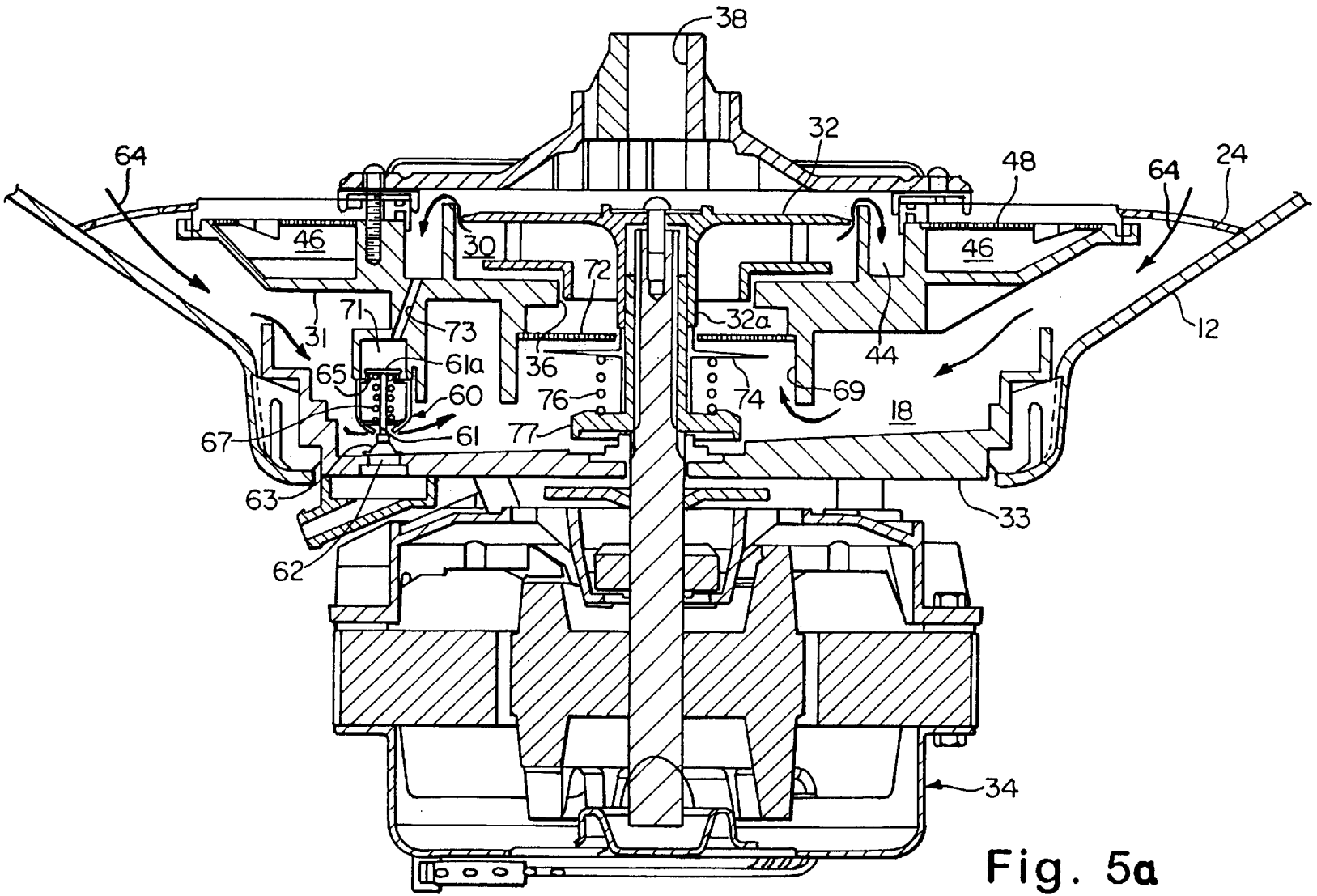
FIG. 5*a* is a diametric sectional view taken along line V—V of FIG. 3, showing the control valve in a closed position.
Figure 5B:
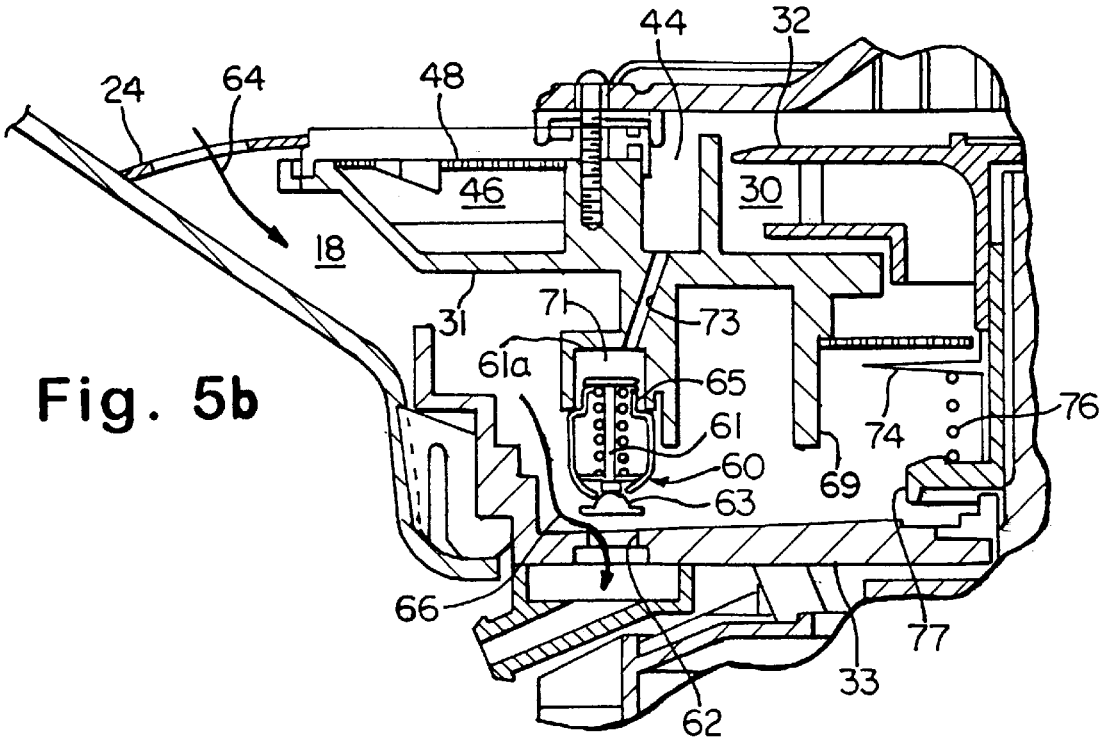
FIG. 5*b* is a partial sectional view illustrating the control valve in an open position, again taken along line V—V of FIG. 3.

Turning now to FIGS. 5*a* and 5*b,* it can be understood that in addition to drawing wash liquid from the soil accumulator 50, the drain pump 54 can drain the sump region 18 by drawing wash liquid through a drain port 62. However, to purge the accumulator 50 as quickly and effectively as possible, it is necessary to hydraulically isolate the accumulator 50 from the rest of the dishwasher when the drain pump is purging. Accordingly, during the wash cycle, when the wash impeller 32 is recirculating wash liquid throughout the interior wash chamber 14, the drain port 62 is closed by a pressure operated control valve system 60 such that the sump 18 is separated from the drain pump when the wash pump 28 is operating.

The control valve system 60 may be any type of system responsive to pressure generated by the operation of the wash pump 28 but is illustrated as a movable valve stem 61 supporting a plug seal 63. The valve stem 61 is supported along the underside of the pump housing 31. The valve stem 61 includes an upper pressure surface 61 a secured to a flexible diaphragm 65. A coil spring 67 is compressed between a spring retainer 69 and the backside of the upper pressure surface 61 a such that the upper pressure surface 61 a is urged upwardly into a cavity 71. The pressure cavity 71 is fluidly connected to the annular guide channel 44 via a conduit 73 such that the control valve 60 is responsive to the pressure generated by the wash impeller 32.

Accordingly, when the wash impeller 32 is recirculating wash liquid within the pump chamber 30, the valve stem 61 is forced downwardly, as shown in FIG. 5*a,* responsive to the pressure in cavity 71 such that the plug seal 63 operates to seal the drain port 62. When the wash impeller 32 is not being rotated or when there is insufficient wash liquid to pressurized the cavity 71, the valve stem 61 is biased upwardly such that plug seal 63 is raised above the drain port 62, as shown in FIG. 5*b,* to open the drain port 62 when the wash pump 28 is not in operation.

As can be clearly seen in FIG. 5 and 5*a,* when the control valve 60 is closed, the drain pump 54 only draws wash liquid from the accumulator 50 when it is energized to purge soils, as illustrated by flow lines 64. It can be understood, therefore, that when the drain pump 54 is energized during the wash cycle, the accumulator 50 and the soil separation channel 46 are purged very quickly which reduces the pressure within the accumulator 50 and the soil separation channel 46 such that the backwash nozzles 51 can clean the filter screen 48. As a result, the accumulator 50, the soil separation channel 46 and filter screen 48 are cleared very quickly such that very little water—as little as 0.1 liters per purge—need be sent to drain to achieve an effective purge period.

Fluid flow through the soil separator and pump assembly 20 when the control valve 60 is allowed to open and the drain pump 54 is energized is shown in FIGS. 4 and 5*b.* Flow lines 66 illustrate the path of wash liquid drained from the sump through drain port 62. At the same time, wash liquid is drained from the accumulator 50 through drain conduit 55.

The control valve system 60 can be used to separate the sump 18 from the accumulator 50 during the initial portion of a drain cycle to avoid soil redeposition onto the dishes. This can be accomplished by continuing to operate the wash pump 28 during the early portion of the drain cycle to keep the control valve 60 in a closed position such that wash liquid is initially drained only through the accumulator 50 wherein the accumulator 50 is cleared of soils and rinsed by water entering from the sump. After some period of time or when the wash pump 28 begins to starve, the motor 34 may be deenergized such that the control valve 60 opens.

It can be understood by one skilled in the art that the operation of control valve system 60 allows for a thorough pump-out of wash liquid during drain such that little wash liquid remains in the sump 18 at the completion of a drain cycle. It would be possible, however, to provide an alternative embodiment of the present invention by omitting the control valve system 60. In such an embodiment, all wash liquid would be drained from the dishwasher through the soil accumulator 50.

Figure 7:
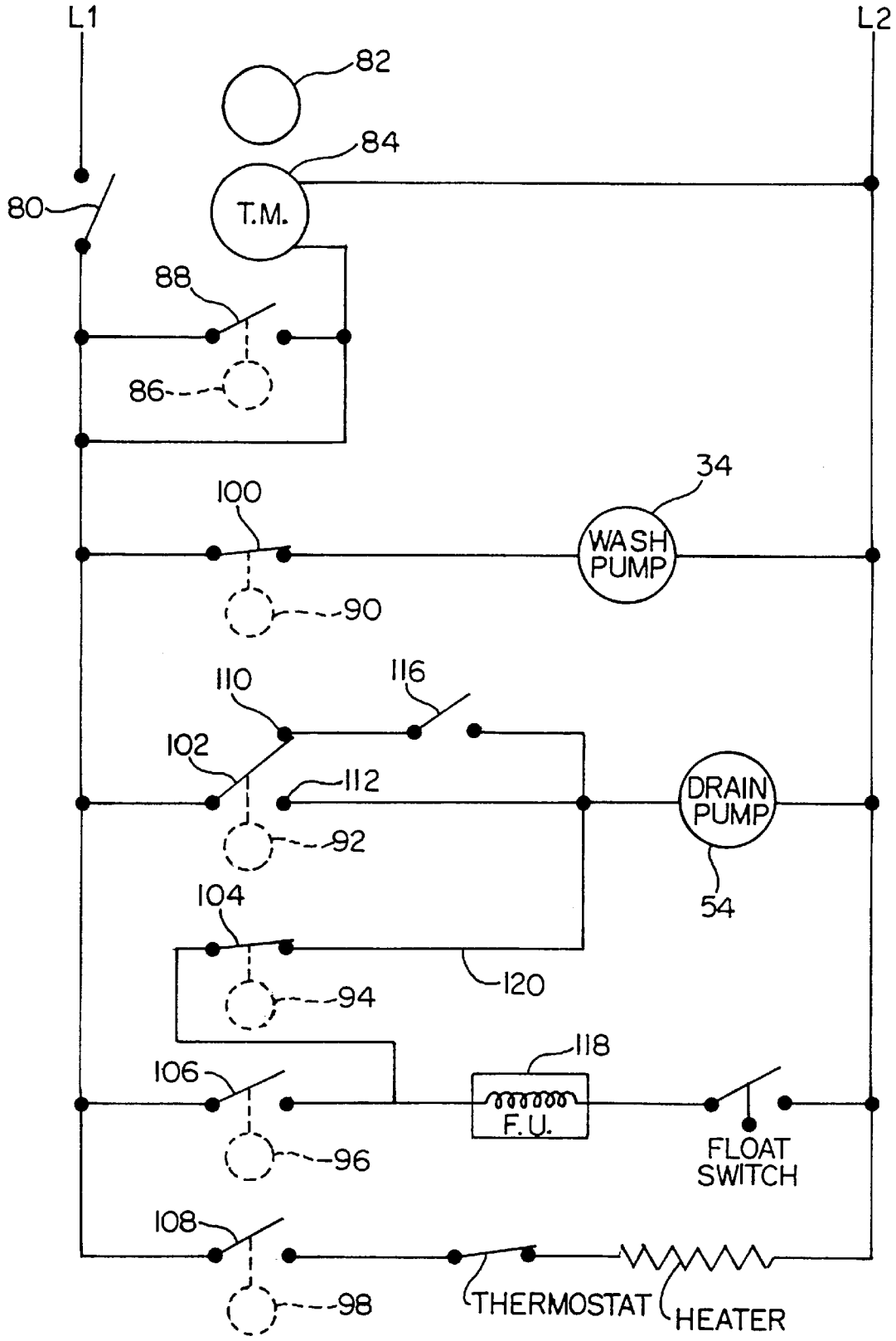
FIG. 7 is a schematic representation of electrical circuitry for an electromechanical embodiment of the dishwasher shown in FIG. 1.

Components of an electromechanical embodiment of the present invention are shown in FIG. 7. Current to the dishwasher is provided through lines L1 and L2. An interlock door switch 80 ensures that the dishwasher is deenergized when the door is opened. The dishwasher is started in its operating cycle by manipulation of a control knob 82. The control knob 82 is rotated a few degrees to turn the shaft of a timer motor 84 whereby cam 86 causes switch 88 to close, thereby energizing the timer motor 84. The advancing timer motor 82 rotates cams 90, 92, 94, 96 and 98 for selectively controlling switches 100, 102, 104, 106 and 108, respectively.

When switch 102 is positioned to complete the circuit through contact 110, the drain pump 54 is energized whenever pressure switch 116, operatively associated to pressure dome 53, closes in response to pressure in the accumulator 50 exceeding the predetermined limit pressure. Similarly, the drain pump 54 is deenergized when the pressure in the accumulator 50 falls below the predetermined limit pressure and the switch 116 opens. It can be understood that the drain pump 54 cycles on and off independently of the timer motor 84 rotation such that very short purge intervals are possible. Moreover, the drain pump 54 is energized independently of the wash pump motor 34.

The wash liquid sent to drain during each purge period may be replaced by having cam 94 close switch 104 such that fill valve 118 is energized simultaneously with the drain pump 54. During the machine fill portion of the dishwasher cycle, switch 104 is open and the fill valve 118 is energized through switch 106.

Alternatively, the wash liquid sent to drain during each purge period may also be accounted for by simply supplying a small amount of additional water into the dishwasher during the initial fill cycle wherein switch 104 and line 120 may be omitted from the dishwasher circuit. This "overfill" approach is a realistic alternative, given that only a small amount of wash liquid—as little as 0.1 liter—is sent to drain during each purge period.

Figure 8:
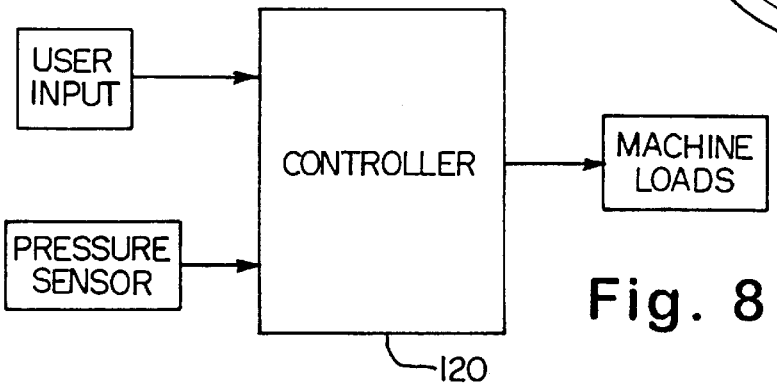
FIG. 8 is a schematic representation of the control elements for an electronic embodiment of the dishwasher shown in FIG. 1.
Figure 9:
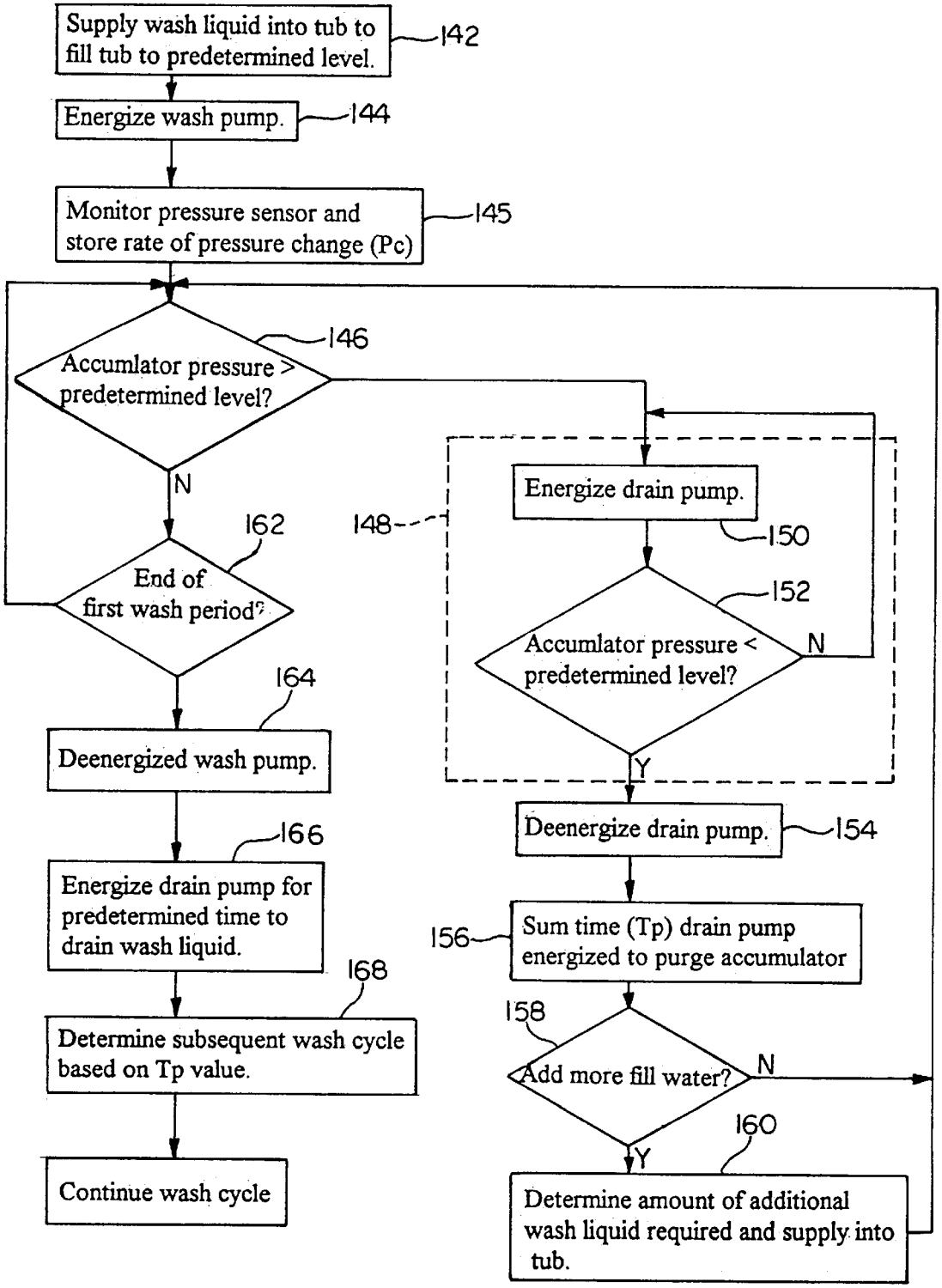
FIG. 9 is a flow chart illustrating the operation of an alternate embodiment of the dishwasher shown in FIG. 1 having a microprocessor control means.

FIG. 8 illustrates an electronic control embodiment of the present invention utilizing a microprocessor controller 120 which employs the control logic shown in FIG. 9.

Turning now FIG. 9, in steps 142 and 144, wash liquid is supplied into the dishwasher tub to a predetermined level whereupon the wash pump 34 is energized. In step 145, the controller 120 monitors the pressure within the accumulator 50 via input from the pressure sensor 52 and stores the rate of pressure change (Pc). If the pressure exceeds a predetermined limit, as shown in step 146, apurge routine 148 comprising steps 150 and 152 is initiated. After the accumulator 50 has been purged and the filter screen 48 is cleared, the drain pump 54 is deenergized in step 154. The drain pump may be deenergized when the accumulator pressure falls below the predetermined limit pressure. Alternatively, the drain pump may remain energized some predetermined time after the accumulator falls below the predetermined limit pressure or until the accumulator pressure reaches some predetermined reset pressure, lower than the predetermined limit pressure.

In steps 156, 158 and 160 the controller 120 counts the number of times (Np) the purge routine is initiated and sums the time (Tp) the drain pump was energized during the preceding purge periods. Based on that information, the controller 120 determines whether additional wash liquid is required to replace the quantity of water sent to drain during the prior purge routines. The purge routine 148 is initiated as frequently as required in response to pressure sensor 52 and is performed while the wash pump continues to recirculate wash liquid within the dishwasher. At the end of the initial wash period, the wash pump is deenergized and the wash liquid is drained from the dishwasher, as shown in steps 162, 164 and 166.

Following the initial wash period, the dishwasher cycle can be modified, as shown in step 168, in response to gathered information—Pc, Tp or Np—indicative of the quantity and type of soil. For example, the duration of the wash cycle length may be increased when heavy soil load is sensed as determined by the number of purge routines or additional fills may be added to the cycle. In this manner, the dishwasher is responsive to the soil load for selecting the optimum wash cycle.

The present invention may be readily employed in a fully automatic manner to provide a uniquely simple dishwasher cycle of operation. Specifically, the present invention makes it possible to effectively wash dishes with a two fill cycle as compared to present systems which typically require at least 5 fill cycles. In the two fill wash cycle, during the first fill cycle the dishwasher is operated to wash the dishes wherein the pump system is repeatedly purged until soil quantities in the wash liquid are reduced to a very low level. The second fill cycle can then be used as the single rinse cycle. Additionally, if initial soil levels are so low that there is no resulting accumulator pressure, as may occur with pre-rinsed dishes, the two fill cycle will be used as the normal cycle.

Figure 10:
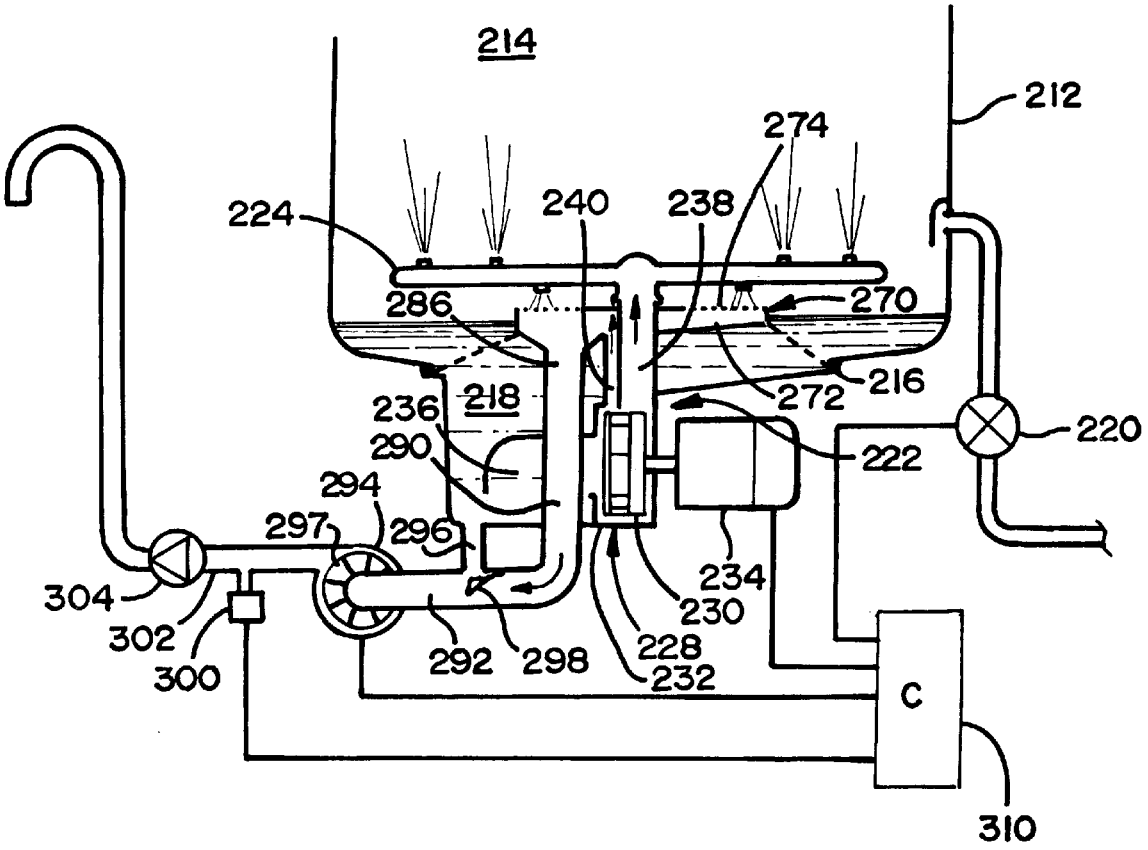
FIG. 10 is a schematic illustration an alternative embodiment of the soil separation and collection system of the present invention.

FIG. 10 discloses an alternative embodiment of the present invention wherein a highly efficient volute pump is combined with a soil separation system. The dishwasher includes a wash tub 212 forming an interior wash chamber or dishwashing space 214. The wash tub 212 includes a bottom wall 216 having a downwardly sloped portion which defines a lower tub region or sump 218 for receiving wash liquid inlet into the tub 212 through a fill valve 220. A soil separator and pump assembly 222 is located in the sump 218 for recirculating wash liquid from the sump 218 through the tub 212. A wash arm assembly 224 is provided above the pump assembly 222 and receives wash liquid from the pump system 222.

The soil separator/pump assembly 222 includes a highly efficient volute pump 228. The volute pump 228 is a centrifugal pump having a wash impeller 230 rotated about a horizontal axis within a pump chamber 232 which defines a spiral casing such that speed will be converted to pressure without shock within the pump chamber. During a wash cycle, the wash impeller 230, driven by motor 234 (FIG. 11), draws wash liquid from the sump 218 through a pump inlet 236 and pumps the wash liquid out through a main outlet 238 and a secondary outlet 240. Wash liquid pumped through the main pump outlet 238 is directed to flow into the lower spray arm 224. Wash liquid flowing through the secondary outlet is directed to flow into a soil collector 270. Wash liquid is repeatedly recirculated throughout the wash tub 212 for removing soils from dishware supported therein.

Figure 11:
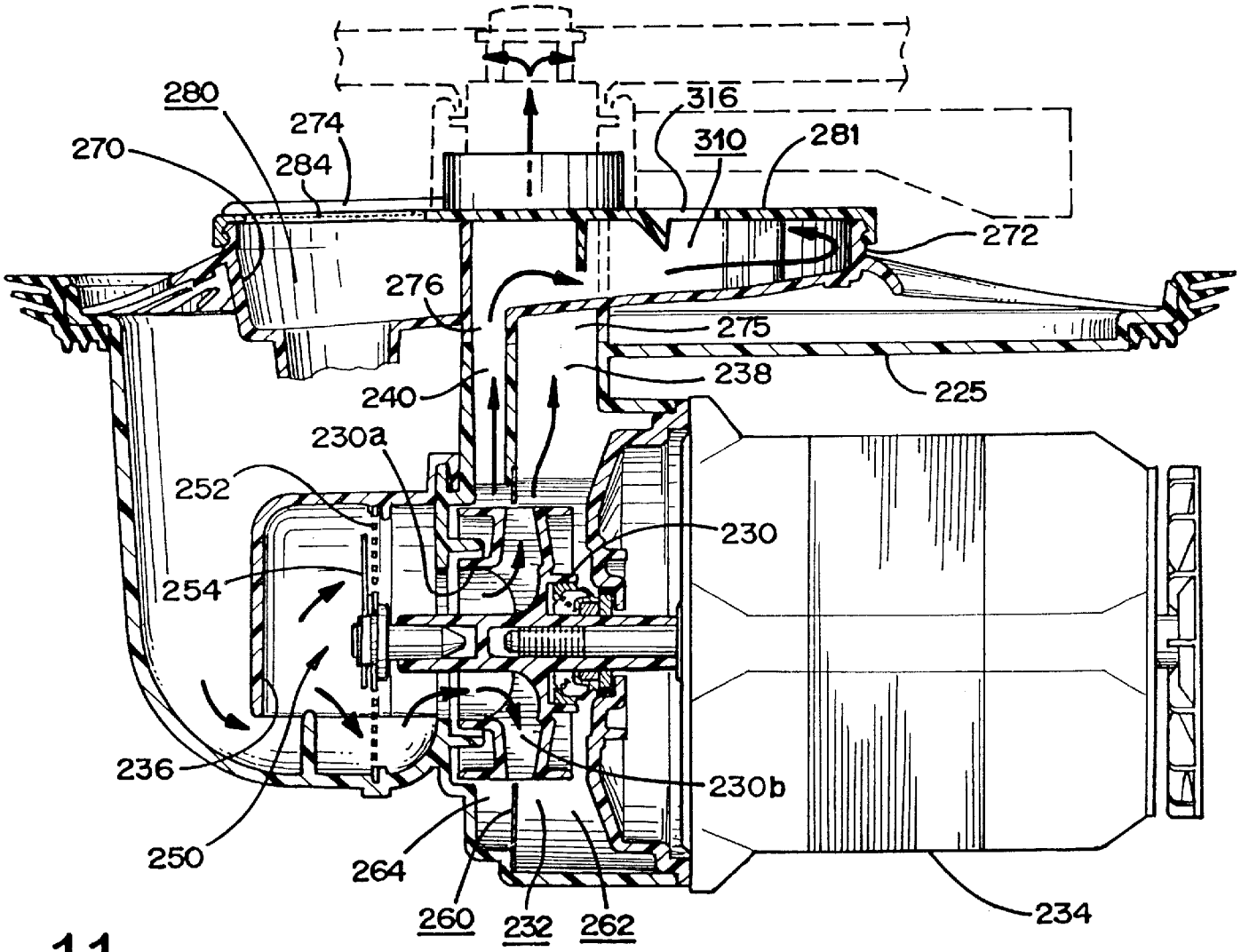
FIG. 11 is a sectional view of the pump and soil separation system of the alternative embodiment shown in FIG. 10, illustrating fluid flow through the wash pump and into the soil collector.
Figure 12:
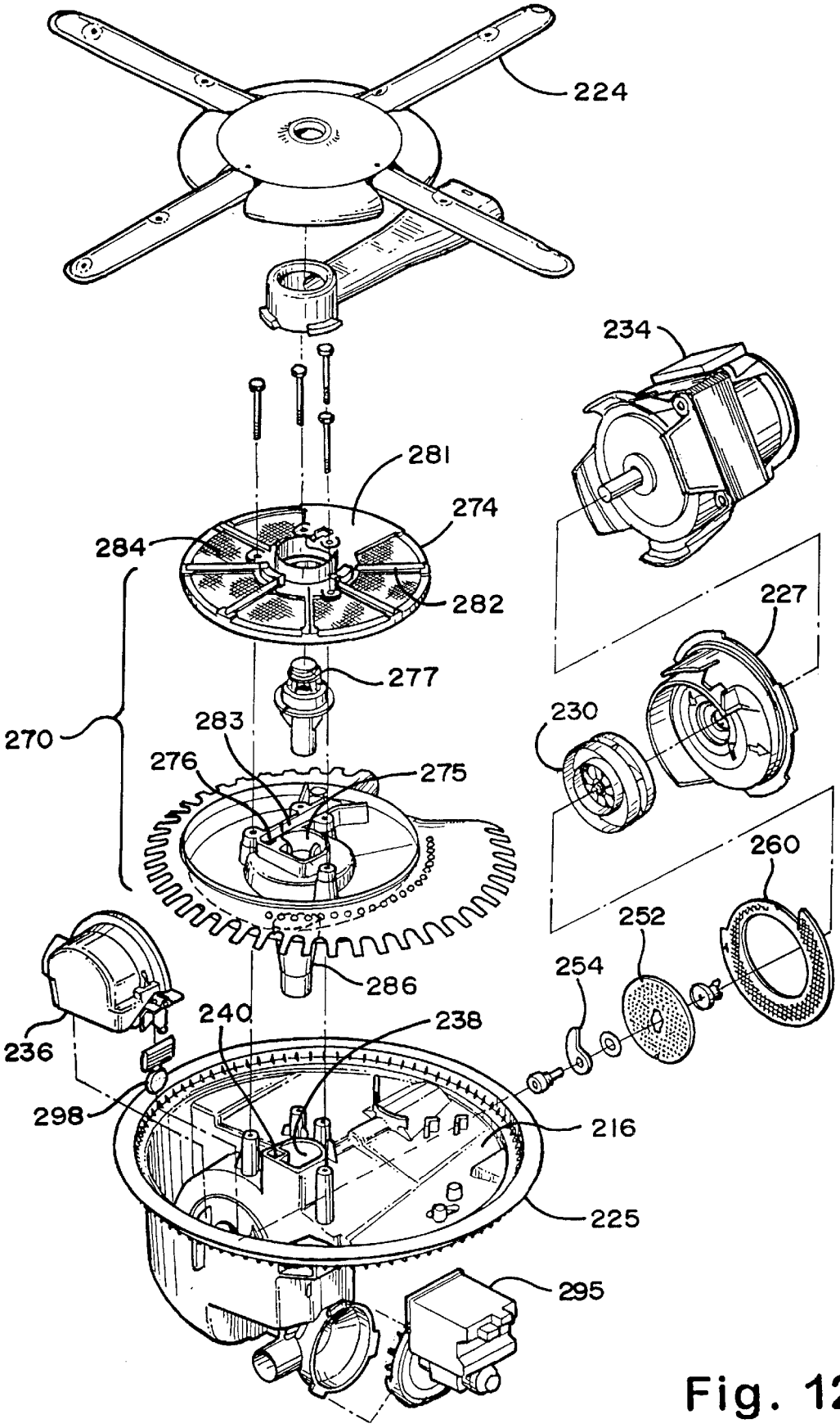
FIG. 12 is an exploded, perspective view of the alternative pump and soil separation system shown schematically in FIG. 10.

The present invention can be better understood now, by referring to FIGS. 11 and 12 which show specific detail of the basic structure shown in FIG. 10. For example, it can be seen that the pump chamber 232, the pump inlet 236, the main outlet 238 and the secondary outlet 240 can be formed in part by a member 225 which forms part of the tub bottom 216. A volute member 227 may further contribute toward forming the pump chamber 232, the main outlet 238 and the secondary outlet 240. While this structure is shown as a particular embodiment of the invention, it is clearly just one example of how the present invention may be practiced.

Wash liquid drawn into the pump inlet 236 passes through a chopper assembly 250. The chopper assembly includes a sizing plate 252 and a chopper blade 254. The chopper blade 254 rotates adjacent the sizing plate 252 and chops food particles entrained within the wash liquid to size sufficient to allow the food particles to pass through the sizing plate. After being chopped and sized by the chopper assembly 250, the soils are drawn, along with the wash liquid, into the pump chamber 232.

Within the pump chamber 232, the soils are partially separated and concentrated by the operation of a filter plate 260 located within the pump chamber 232. The filter plate 260 is a flat filter with an inner diameter (I.D.) greater than the outer diameter (O.D.) of the wash impeller 230 and which is located about the wash impeller 230 perpendicular to the axis of rotation of the wash impeller 230. The filter plate 260 separates the pump chamber into first region or side 262 and a second region or side 264. During the dishwasher operation, wash liquid is drawn through the pump inlet 236, into the eye of the wash impeller 230*a*, and is moved outwardly from the center of the impeller 230 by the impeller vanes 230*b*.

Wash liquid coming off of the impeller 230 is divided into two portions by the filter plate 260 such that a first portion passes from the impeller into the first region 262 of the pump chamber 232 and a second portion passes from the impeller into the second region 264 of the pump chamber 232. The main outlet 238 provides an outlet for the first region 262 of the pump chamber 232. The secondary outlet 240 provides an outlet for secondary region 264 of the pump chamber 232. The secondary outlet 240 is sized relatively small such that when the wash impeller 230 is pumping wash liquid, the pressure in second region 264 of the pump chamber 232 is greater than the pressure in the first region 262 of the pump chamber 232. The pressure difference across the filter plate 260 is caused by the fact that the ratio of the first portion of wash liquid pumped from the impeller 230 into the first region 262 to the second portion of wash liquid pumped from the impeller 230 into the second region 264 is greater than the ratio of the size of the main outlet 238 to the size of the secondary outlet 240.

It can be understood, therefore, that a portion of the wash liquid coming off the wash impeller 230 into the second region 264 of the pump chamber 232 passes through the secondary outlet 240 and the remainder passes through the filter plate 260 traveling from the second region 264 of the pump chamber 232 into the first region 262 of the pump chamber 232. This flow through the filter plate 260 from the second region 264 to the first region 262 results in the filtering of soils and a concentrating of soil in the second region 264 such that the wash liquid sent through the secondary outlet 240 has a concentration of soils greater than the concentration of soils in the wash liquid being drawn into the eye of the pump impeller, at least for a first portion of the wash cycle.

Figure 14:
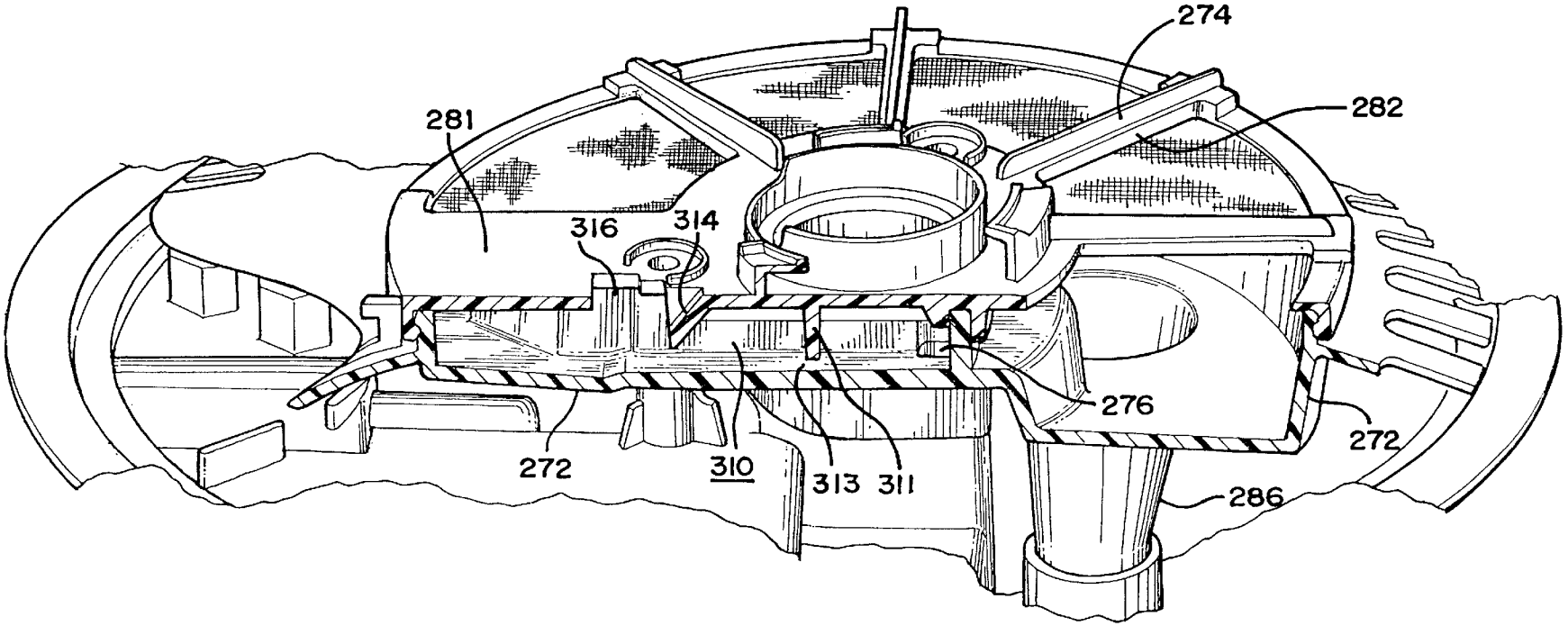
FIG. 14 is a cross-sectional view taken along lines XIV—XIV of FIG. 13 showing the inlet conduit into the soil separation channel.

Wash liquid and entrained soils flow, therefore, through the secondary outlet 240 into the soil collector 270. As shown in FIG. 14, the soil collector includes a main body 272 and a top panel 274. The main body 272 is a generally circular, cup-like member which is secured to the bottom wall 216 of the wash tub 212. The main body 272 includes an outer flange which forms a coarse grate through which wash liquid flows on its path toward the pump inlet 236. The main body 272 has a center opening or conduit 275 which receives fluid flow from the main outlet 238 of the pump chamber 232. A bearing hub 277 may be partially positioned in the center conduit 275 for directing wash liquid to the spray devices 224. The main body further includes an inlet 276 for receiving wash liquid from the secondary outlet 240.

The top panel 274 forms a top wall of the soil collector 270. The top panel 274 has a solid wall portion 281 which overlies the inlet 276. The solid wall portion 281 and a channel 283 in the main body 272 combine to form an inlet conduit or path 310 (FIG. 11). The top panel 274 further includes a plurality of openings 282 which are provided with filter screen panels 284. The portion of the top panel 274 which includes a plurality of openings 282 combines with the main body 272 for forming a soil separation channel 280.

Wash liquid flowing through the secondary outlet 240 is received into the soil collector 270 through the inlet 276 and is directed to pass through the inlet conduit or path 310 formed between the main body 272 and the top panel 274. After passing through the inlet conduit 310, the wash liquid is directed to flow into the soil separation channel 280 formed between the main body 272 and the top panel 274. The separation channel 280 is provided about the center opening 275 but could be in different configurations, including a linear configuration. Many of the constructional features of the separation channel are explained in U.S. Pat. No. 5,803,100.

The main body 272 further includes a downwardly projected portion 286 which defines a soil accumulation region or sump 288 for the soil collector 270. As the soil laden wash liquid proceeds within the separation channel 280, water passes upwardly through the filter screen panel 284 leaving the soils within the separation channel 280. Within the soil separation channel 280, soils are directed to generally accumulate in the soil accumulation region or sump 288.

Figure 13:
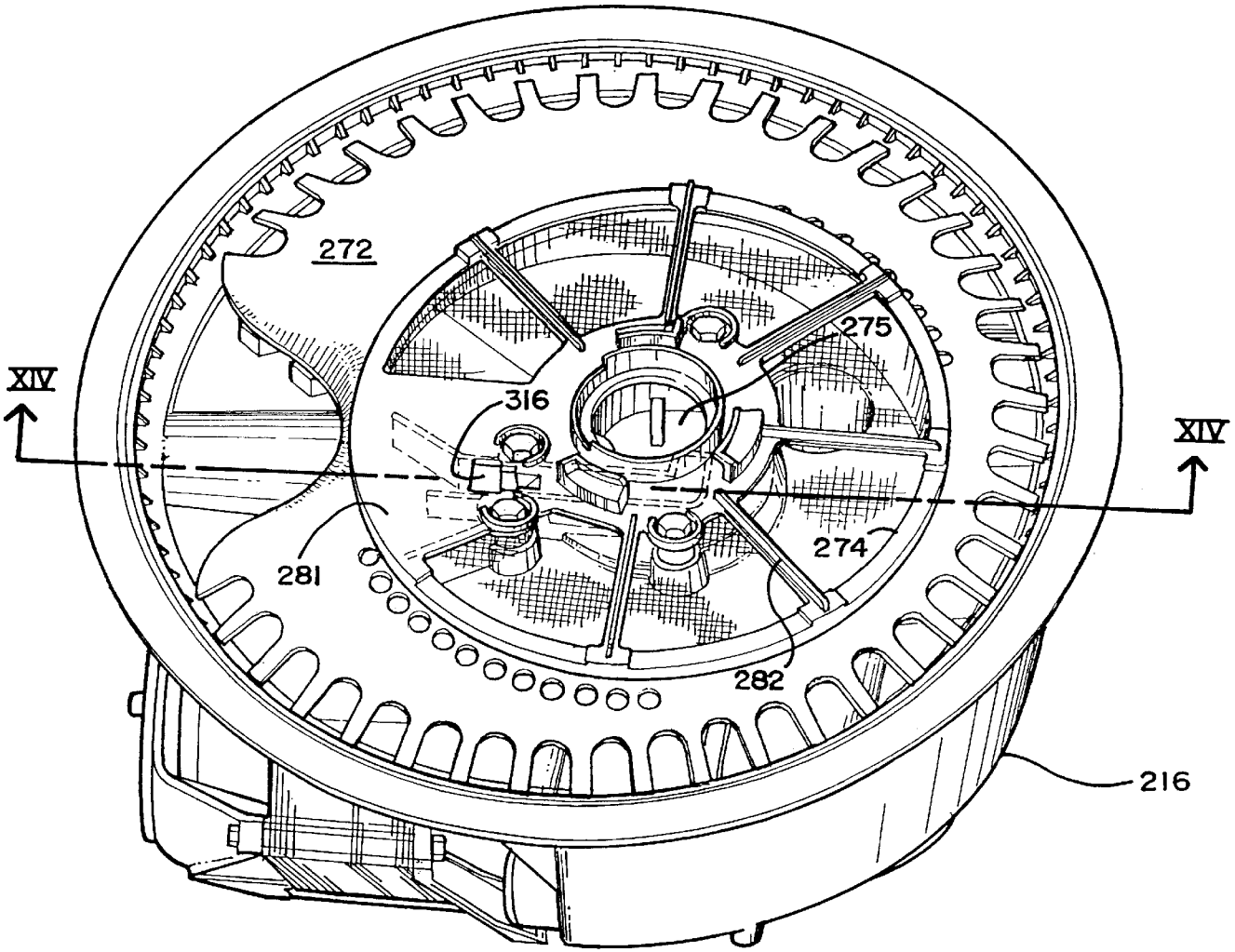
FIG. 13 is a perspective view of the alternative pump and soil separation system shown schematically in FIG. 10.

The flow of the wash liquid into the soil collector 270 can be better understood by referring now to FIGS. 13 and 14. FIG. 14, in particular, shows details of an example of a possible inlet conduit 310. As described above, wash liquid flows from the inlet 276 through the inlet conduit 310 and passes into the separation channel 280. A rib 311 in the inlet conduit 310 forms a set orifice 313 through which wash liquid must flow to enter the separation channel 280 for limiting the amount of flow and increasing the pressure/velocity being delivered to the separation channel 280. In one embodiment, an angled wall section 314 is provided in the inlet conduit 310 immediately upstream of an opening or second outlet 316 provided in the solid wall portion 281. The angled wall section 314 forms a venturi in the inlet conduit 310 to increase the speed of the wash liquid for forming a jet and to deflect the wash liquid flow through the inlet conduit 310 to insure the jet is directed past the opening 316 in the inlet conduit. Accordingly, due to the angle and velocity of the wash liquid, a slight suction may be generated at the opening 316.

In a normal wash mode, the present invention operates to send wash liquid through the inlet conduit 310 such that soils may be stored in the soil collector 270. However, it is possible that the soil collector 270 may become filled with soils such that further wash liquid can not be supplied therein due to the clogging of the filter screens 284 with soils. When this occurs, the soil collector 270 will become pressurized as discussed above. According to the present invention, the pressure generated by the overloaded or clogged filter screens 284 will cause the wash liquid flowing in the inlet conduit 310 to be redirected out of the soil collector 270 through the opening 316. It can be appreciated that the soils already captured in the soil collector 270 remain in the soil collector 270. The pump system may remain operating in this mode until the filter screen panels 284 are either cleaned by back-wash nozzles or by a full or partial drain of the system.

It can be appreciated that the design of a venturi inlet system for a soil collector is a delicate balancing act between the many interconnecting flow paths. For instance, in order for soils not to be lost from the soil collector 270 when the filter screens are clogged, the pressure into the soil collector 270 must be enough to prevent the back wash nozzles from generating an additional flow through the opening 316. Also, the venturi must be sized so as to relieve the build-up of pressure prior to it overcoming the drain loop on the exterior of the dishwasher, which prevents the pumping of water down the drain line during the wash cycle. A standpipe (not shown) internal to the dishwasher tub may be provided as an alternative to the venturi. If a standpipe is used as part of the inlet to the soil collector 270, instead of having the design of the venturi regulating when the system stops collecting soils, the height of standpipe path performs this function.

The second outlet 316, therefore, provides a soil collector bypass system when the filter screens 284 are clogged. This bypass system is particularly useful for an embodiment of the present invention which does not include automatic purging of the soil collector. However, the bypass system may also be employed with an automatic purge type system, as will described hereinbelow.

Figure 15:
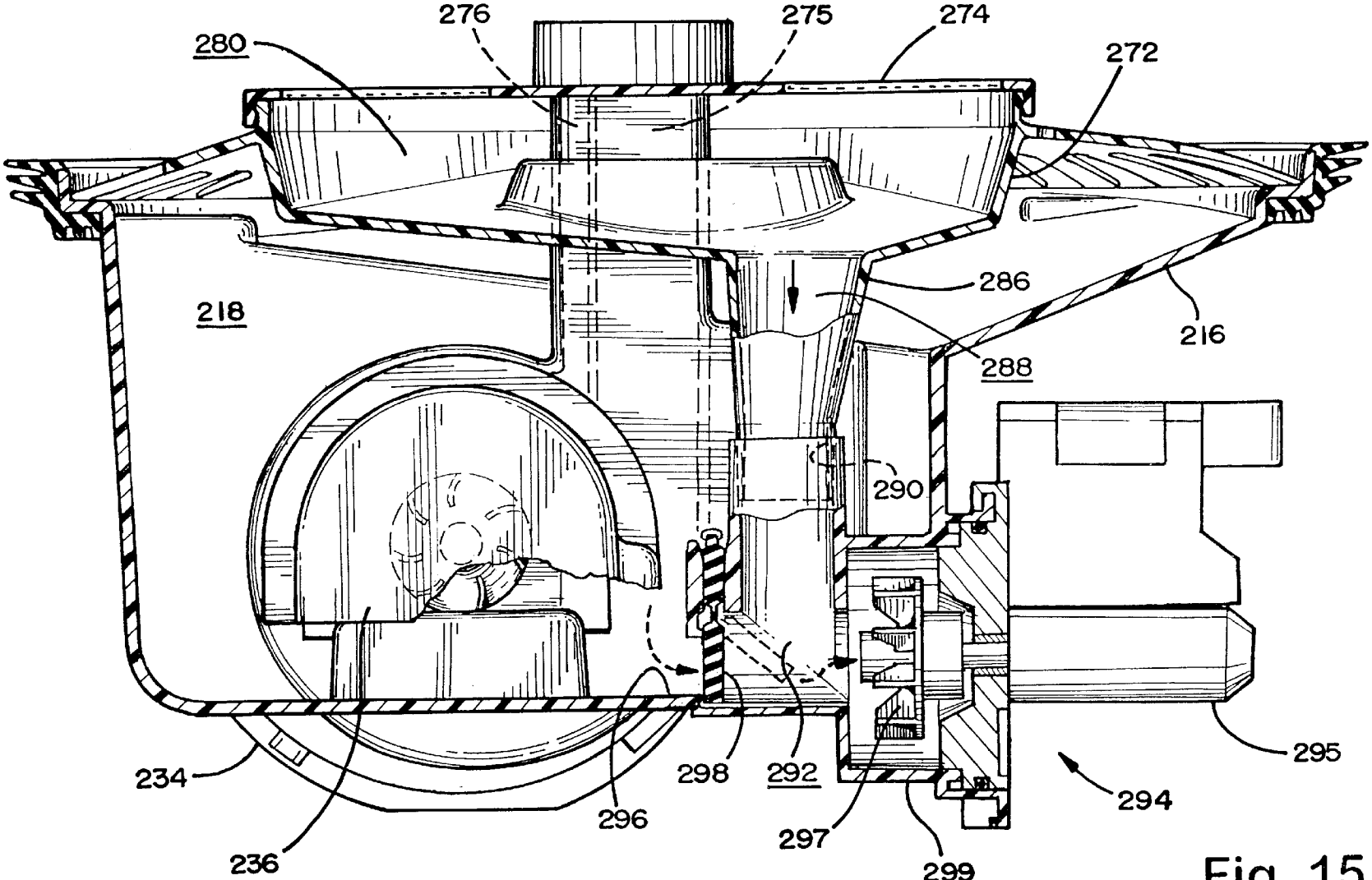
FIG. 15 is a sectional view of the pump and soil separation system of the alternative embodiment shown in FIG. 10, illustrating fluid flow from the soil collector into the drain pump.

As shown in FIG. 15 and in FIG. 10, a drain pump 294, separate from the wash pump 228, is provided for draining wash liquid from the dishwasher tub 212. The drain pump 294 includes a drain motor 295 drivingly connected to a drain impeller 297 located within a housing 299. Located at the bottom of the downwardly projected portion 286 is an outlet opening 290 which is fluidly connected with an inlet area 292 for the drain pump 294. An opening 296 is also provided into the inlet area 292 from the sump 218. A flapper type check valve 298 is provided at the opening 296 for selectively controlling the flow of liquid from the sump 218 into the inlet area 292 of the drain pump 294 based on the pressure difference across the valve 298. Preferably, when the wash pump 228 is operating, pumping fluid into the soil collector 270 and pressurizing the inlet area 292, the pressure in the inlet area 292 will be greater than the sump 218 such that the valve 298 will be closed. Moreover, the suction from the wash pump 228 may also contribute toward drawing the valve 298 into a closed position. When the wash pump 228 is not pressurizing the inlet area 292, the flapper may open to allow wash liquid to flow from the sump 218 into the inlet area 292.

During the wash cycle, the filter screen panels 284 are repeatedly backflushed. As the lower wash arm 224 rotates, pressurized wash liquid is emitted from downwardly directed backflush nozzles. Means may be provided for forming a fan-shaped spray from the flow of wash liquid through the backflush nozzles. As the lower wash arm rotates, this fan shaped spray sweeps across the filter screens 284 providing a backwashing action to keep the screen clear of soil particles which may impede the flow of cleansed wash liquid into the sump 18. As described above, in spite of backflushing, in conditions of a heavy soil load, the filter screen panels 284 may become clogged with food soils. When this occurs, wash performance is impaired and pressure within the soil collector 270 may increase to an undesirable level.

To address the problem of the filter screen panels becoming clogged with food soils, the present invention discloses a system for periodically purging the soil collector 270 to avoid the problems of filter screen clogging. The basic principle of the purging system is to purge the soil collector 270 in response to pressure within the soil collector 270. To that end, a pressure sensor 300 is provided for monitoring the pressure within the soil collector 270. The pressure sensor is shown in FIG. 10 as being mounted on a drain line 302 downstream of the drain pump 294 but upstream of a drain check valve 304. The pressure sensor 300, however, could alternatively be located upstream of the drain pump 294 on the inlet area 292, the accumulator region 288 or in the separation channel 280. The pressure sensor 300 can be either an analog device or a digital device.

During the wash mode when the wash pump 228 is recirculating wash liquid through the tub 212, the drain pump 294 is energized to clear the soil collector 270 and filter screen panels 284 when the pressure in the soil collector 270 exceeds a predetermined limit pressure, indicative of a clogged filter screens 284. This operation of the drain pump 294 to clear the soil collector 270 while the wash pump 228 continues to recirculate is referred to as purging or a purging operation. During the purging operation, the drain pump 294 is energized while the wash pump 228 continues to recirculate wash liquid through the tub 212.

As shown in FIG. 10, a controller 310 is operatively connected to the drain pump 294, the wash pump motor 234, the pressure sensor 300 and the fill valve 220 for operating the dishwasher in accordance with the present invention and, in particular, to operate the dishwasher to perform the purging operations. The controller 310 is an electromechanical controller or a microprocessor based programmable controller—both of which are known in the prior art.

Figure 16:
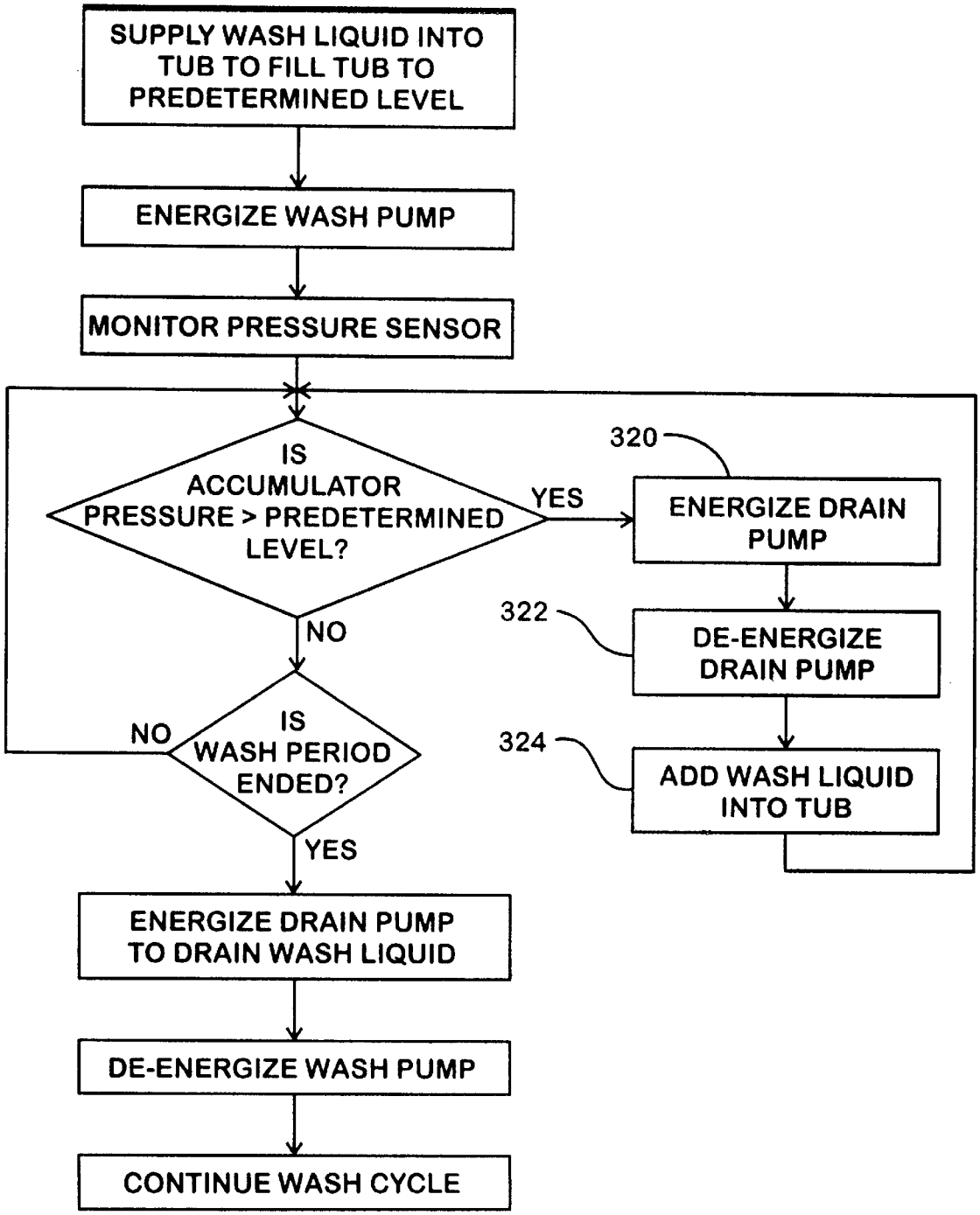
FIG. 16 is a flow chart illustrating the operation of the alternate embodiment of the dishwasher shown in FIG. 10.

In operation, as shown in FIG. 16, after fill liquid is initially supplied into the tub 212 and the wash pump 228 is energized, the pressure sensor 300 is monitored. If the pressure sensor 300 provides a signal to the controller 310 indicating that the pressure within the soil collector 270 exceeds a predetermined limit, the drain pump motor 295 is energized for drawing wash liquid, highly concentrated with soils, from the soil accumulator region 288, through drain pump inlet area 292 and pumping the wash liquid to drain past the check valve 304, as shown at step 320. The drain pump 294 may operate for a preselected period of time—such as 5 seconds. After the 5 seconds, the drain pump 294 is de-energized, shown at step 322. Fill liquid may be added to the tub 212 to replace the purged wash liquid, step 324. After a period of time which allows the pressure within the soil separator to equalize, the pressure sensor 300 may be again monitored to determine if the pressure within the soil collector 270 exceeds a predetermined limit.

The purging operation can be repeated if the pressure sensor again senses a pressure within the soil collector 270 which exceeds the predetermined limit, the drain pump will be energized for a period of time. During a wash period of the dishwasher cycle, the soil collector 270 may be repeatedly purged in this manner. If however, the number of purges exceeds some predetermined number, the controller may be programmed to drain the entire dishwasher and refill the dishwasher with completely fresh water.

During each purging operation, it is desirable that the drain pump 294 operate to purge wash liquid from just the soil collector 270. To this end, the flapper valve 298 is designed to prevent wash liquid from flowing from the sump 218 into the inlet area 292 during the purging operations. However, some small amount of wash liquid flowing from the sump 218 into the inlet area 292 and from there to drain during purging can readily be tolerated. Since the drain pump 294 is operated for such a short time during purging, leakage from the sump into the drain pump 294 during purging will not significantly affect the efficiency of the present invention. In fact, it can be understood that present invention can be practiced in dishwasher designs wherein wash liquid is drained from the sump 218 during the purging operation through both the soil collector outlet opening 290 and the sump opening 296.

It can be appreciated that if the pressure sensor 300 is moved upstream of the drain pump, the drain pump may be energized during a purging operation when the pressure within the soil collector 270 exceeds a predetermined limit and the drain pump 294 can be de-energized when the pressure in the accumulator is lowered below the predetermined limit pressure the drain pump 294.

It can be seen, therefore, that the present invention provides for a substantial improvement in the efficiency of dishwasher operation. The present invention provides a unique pump system which washes dishes in a manner superior to the dishwashers presently available for sale while using substantially less energy and water than presently available dishwasher systems. Specifically, the inventors calculate that the present invention, if employed on all dishwashers in the United States (U.S.), would save almost 24 billion gallons of water a year and almost 4 billion KWH's per year—based on an assumption of 18 million dishwashers in use in the U.S. operated 300 times a year (6 times a week for 50 weeks a year).

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. A dishwasher having a tub forming an interior wash chamber including a bottom wall, the tub receiving wash liquid from an inlet, the dishwasher comprising:

a sump region defined by the bottom wall of the wash chamber, the sump having a sump outlet;

a volute pump connected to the bottom wall for recirculating wash liquid throughout the wash chamber, the volute pump having an impeller and a casing surrounding the impeller, the casing having a main pump outlet and a secondary pump outlet;

a wash arm positioned above the volute pump for receiving wash liquid from the volute pump through the main pump outlet and spraying wash liquid within the tub;

a soil collector disposed below the wash arm, the soil collector receiving wash liquid from the volute pump through the secondary pump outlet, the soil collector further having a drain outlet;

a drain pump independently operable from the volute pump for draining wash liquid through the soil collector drain outlet and the sump outlet; and a valve disposed at the sump outlet for selectively opening and closing the sump outlet when the volute pump is operating to pump wash liquid.

2. The dishwasher according to claim 1, further wherein the soil collector further comprises:

a main body which is mounted to the bottom wall of the dishwasher above the volute pump, the main body having an inlet for receiving wash liquid from the secondary pump outlet, a channel for receiving wash liquid from the inlet, and a first outlet fluidly connected to the drain pump; and a top panel which connects to the main body for forming a top wall on the main body, the top panel including a filter screen wherein wash liquid received into the soil collector flows into the channel and passes through the filter screen such that soils are collected in the soil collector.

3. The dishwasher according to claim 2, further wherein the main body includes a soil accumulation region or sump such that soils retained in the soil collector accumulate in the soil accumulation region.

4. The dishwasher according to claim 2, wherein the soil collector further includes a second outlet through which wash liquid pumped into the soil collector inlet exits from the soil collector when the filter screen become clogged with soils.

5. The dishwasher according to claim 1, wherein the soil collector further includes:

at least one wall having a filter screen for passing wash liquid through; and a second outlet through which wash liquid exits from the soil collector when the filter screen become clogged with soils.

6. The dishwasher according to claim 5, wherein a venturi is associated with the second outlet of the soil collector such that wash liquid exits the soil collector through the second outlet when the filter screen is clogged.

7. The dishwasher according to claim 1, wherein the valve disposed at the sump outlet closes the sump outlet when the pressure in the sump is less than the pressure in the drain pump inlet.

8. A dishwasher having a tub forming an interior wash chamber including a bottom wall, the tub receiving wash liquid through a water inlet, the dishwasher comprising:

a volute pump connected to the bottom wall for recirculating wash liquid throughout the wash chamber, the volute pump having an impeller and a casing surrounding the impeller, the casing having a main pump outlet and a secondary pump outlet;

a wash arm positioned above the volute pump for receiving wash liquid from the volute pump through the main pump outlet and spraying wash liquid within the tub;

a soil collector disposed below the wash arm, the soil collector receiving wash liquid from the volute pump through the secondary pump outlet, the soil collector further having a drain outlet;

a pressure sensor for sensing fluid pressure within the soil collector; and a drain pump independently operable from the volute pump, the drain pump being fluidly connected to the soil collector drain outlet, wherein the drain pump operates to drain wash liquid from the soil collector in response to the pressure sensor sensing a pressure exceeding a predetermined limit pressure.

9. The dishwasher according to claim 8, further comprising:

a controller operatively connected to the volute pump, the drain pump and the pressure sensor and wherein the controller energizes the wash pump during a wash period and turns the drain pump on and off during the wash period in response to the input from the pressure sensor such that the soil collector is periodically purged of soils during the wash period.

10. The dishwasher according to claim 8, further comprising:

a sump region defined by the bottom wall of the wash chamber, the sump having a sump outlet wherein the drain pump is fluidly connected to the soil collector drain outlet and the sump outlet; and a valve disposed at the sump outlet for selectively closing the sump outlet when the volute pump is operating to pump wash liquid, wherein the drain pump can energized to purge the soil collector while the volute pump is recirculating wash liquid through out the wash chamber.

11. The dishwasher according to claim 8, further wherein the soil collector further comprises:

a main body which is mounted to the bottom wall of the dishwasher above the volute pump, the main body having an inlet for receiving wash liquid from the secondary pump outlet, a channel for receiving wash liquid from the inlet, and a first outlet in fluid communication with the drain pump, and a top panel which connects to the main body for forming a top wall on the main body, the top panel including a filter screen wherein wash liquid received into the soil collector flows into the channel and passes through the filter screen such that soils are collected in the soil collector.

12. The dishwasher according to claim 11, further wherein the main body includes a soil accumulation region or sump such that soils retained in the soil collector accumulate in the soil accumulation region.

13. The dishwasher according to claim 11, wherein the soil collector further includes a second outlet through which wash liquid pumped into the soil collector inlet exits from the soil collector when the filter screen become clogged with soils.

14. The dishwasher according to claim 8, wherein the soil collector further includes:

at least one wall having a filter screen for passing wash liquid through; and a second outlet through which wash liquid exits from the soil collector when the filter screen become clogged with soils.

15. The dishwasher according to claim 8, further comprising:

a sump region defined by the bottom wall of the wash chamber, the sump having a sump outlet;

a valve disposed at the sump outlet; and a drain pump inlet which is fluidly connected to the soil collector outlet and the sump outlet, wherein the valve disposed at the sump outlet closes the sump outlet when the pressure in the sump is less than the pressure in the drain pump inlet.

16. A dishwasher having a tub forming an interior wash chamber including a bottom wall, the tub receiving wash liquid from an inlet, the dishwasher comprising:

a wash pump connected to the bottom wall for recirculating wash liquid throughout the wash chamber, the wash pump having an impeller and a pump housing surrounding the impeller, the pump housing having a main pump outlet and a secondary pump outlet;

a wash arm positioned above the wash pump for receiving wash liquid from the wash pump through the main pump outlet and spraying wash liquid within the tub; and a soil collector disposed below the wash arm, the soil collector receiving wash liquid from the wash pump through the secondary pump outlet, the soil collector including:

an inlet for receiving wash liquid from the secondary pump outlet, a channel for receiving wash liquid from the inlet, the channel having a drain outlet, the channel further having at least one wall having a filter screen wherein wash liquid received into the soil collector flows into the channel and passes through the filter screen such that soils are collected in the soil collector, and a second outlet through which wash liquid flows back into the wash chamber when the filter screen is clogged with soils.

17. The dishwasher according to claim 16, the soil collector further comprising:

an inlet conduit through which wash liquid passes to enter into the channel, wherein the second outlet is located along the inlet conduit.

18. The dishwasher according to claim 17, further wherein the inlet conduit includes a fluid restriction upstream of the second outlet such that fluid flow into the channel is regulated.

19. The dishwasher according to claim 16 wherein a venturi is associated with the second outlet of the soil collector such that wash liquid exits the soil collector through the second outlet when the filter screen is clogged.

20. The dishwasher according to claim 16, further wherein the soil collector further comprises:

a main body which is mounted to the bottom wall of the dishwasher above the wash pump, the main body forming the channel; and a top panel connected to the main body, the top panel forming the at least one wall having a filter screen.

21. The dishwasher according to claim 20 wherein the top panel snap connects to the main body.

22. The dishwasher according to claim 21, further comprising:

a sump provided in the bottom portion of the tub, the sump having a sump outlet;

a drain pump independently operable from the wash pump, the drain pump having an inlet which is fluidly connected to the soil collector outlet and the sump outlet; and a valve disposed at the sump outlet which closes the sump outlet when the pressure in the sump is less than the pressure in the drain pump inlet.

23. The dishwasher according to claim 22, further comprising:

a pressure sensor for sensing fluid pressure within the soil collector;

wherein the drain pump operates to drain wash liquid from the soil collector in response to the pressure sensor sensing a pressure exceeding a predetermined limit pressure.

24. The dishwasher according to claim 23, further comprising:

a controller operatively connected to the wash pump, the drain pump and the pressure sensor and wherein the controller energizes the wash pump during a wash period and turns the drain pump on and off during the wash period in response to the input from the pressure sensor such that the soil collector is periodically purged of soils during the wash period.

25. The dishwasher according to claim 16 wherein the wash pump is a volute type pump and the pump housing forms a casing surrounding the impeller.

* * * * *